US005933869A

United States Patent [19]

Allen

[11] Patent Number: 5,933,869

[45] Date of Patent: Aug. 10, 1999

[54] SPORTS HEADGEAR WITH WIDOW'S VEIL

[76] Inventor: Kathy O. Allen, 12 Calle Maria South, Sante Fe, N.Mex. 87505

[21] Appl. No.: 09/046,215

[22] Filed: Mar. 23, 1998

[51] Int. Cl.[6] ..... A42B 5/00

[52] U.S. Cl. ..... 2/207; 2/172; 2/173; 2/195.1; 2/244; 40/329

[58] Field of Search ..... 2/172, 173, 207, 2/209.13, 10, 244, 195.1; 40/329; D2/865, 869, 872, 882, 895

[56] References Cited

U.S. PATENT DOCUMENTS

| | | | |
|---|---|---|---|
| 5,035,004 | 7/1991 | Koester | 2/173 |
| 5,454,120 | 10/1995 | Rowland | 40/329 |
| 5,546,604 | 8/1996 | Geller | 2/173 |

*Primary Examiner*—Diana L. Oleksa
*Attorney, Agent, or Firm*—Daniel Robbins

[57] ABSTRACT

The present invention discloses sports headgear with an attached widow's veil which covers part or all of the face of the wearer. The headgear is designed to worn by a woman wanting to humorously express her "sorrow" at being displaced by a man's exclusive interest in a sporting activity. The preferred headgear is a peaked baseball cap with the veil attached to the front of the cap. The veil is of fine mesh and has wide interstices so that the face of the wearer, (and her expression), may be clearly seen, and the preferred color of the veil material is black. It will be appreciated that the juxtaposition of a sporting element (the cap) and a badge of sadness (the widow's veil) when worn together, communicates a woman's feelings of being left out of the fun in a wry subliminal manner. Other embodiments of the invention include the baseball cap and veil, with an inscription "WIDOWWEAR" on the crown at the front of the cap along with an icon representing the sport being targeted, e.g. a basketball, baseball, football. As a third embodiment, the cap does not have the veil but has the inscription "WIDOWWEAR" on the crown along with the sports icon.

9 Claims, 3 Drawing Sheets

SPORTS HEADGEAR WITH WIDOW'S VEIL

BACKGROUND OF THE INVENTION

1. Field of the Invention

This invention relates to sports headgear, and in particular to sports headgear designed for women.

2. Description Relative to the Prior Art

Spectator sports are avidly followed by a large portion of the American population, and adult males are by far the majority of fans. Prior to the proliferation of TV, spectator participation in amateur and professional sports was limited to those could attend sporting events at major sports arenas such as baseball parks, football stadiums, golf courses and basketball courts. With the advent of TV, and the widespread broadcasting of professional and amateur sporting events the viewing spectator public mushroomed. Millions of Americans sit glued to their TV sets during the baseball World Series, Superbowl and the competition of the football teams leading to the Superbowl, the Masters Golf Tournament, the NBA basketball games, the NCAA "March Madness" collegiate basketball contests, as well as innumerable other large and small sporting events, and this passion for total absorption in viewing sports in action is predominantly characteristic of the male population. Additionally, while most adult men may not actually play baseball, football or basketball, a large number of men actively and regularly participate in sports such as golf, tennis, fishing and hunting with an enthusiasm that may even exceed that of the spectator sports followers.

Many women, not sharing this overwhelming interest in either spectator or participation sports, find themselves temporarily shunted aside by their menfolks for the duration of the sports activity . This at times gives rise to feelings of isolation and neglect, and while many people have been aware of this temporary sports related gulf between men and women, the prior art has not translated these feelings into tangible, structural elements. The practice of the present invention discloses feminine wearing apparel that communicates these feelings of women in a wry and ironic manner.

SUMMARY OF THE INVENTION

The present invention discloses sports headgear with an attached widow's veil which covers part or all of the face of the wearer. The headgear is designed to worn by a woman wanting to humorously express her "sorrow" at being displaced by a man's exclusive interest in a sporting activity. The preferred headgear is a peaked baseball cap with the veil attached to the front of the cap. The veil is of fine mesh and has wide interstices so that the face of the wearer, (and her expression), may be clearly seen, and the preferred color of the veil material is black. It will be appreciated that the juxtaposition of a sporting element (the cap) and a badge of sadness (the widow's veil) when worn together, communicates a woman's feelings of being left out of the fun in a wry subliminal manner. Other embodiments of the invention include the baseball cap and veil, with an inscription "WIDOWWEAR" on the crown at the front of the cap along with an icon representing the sport being targeted, e.g. a basketball, baseball, football. As a third embodiment, the cap does not have the veil but has the inscription "WIDOWWEAR" on the crown along with the sports icon.

BRIEF DESCRIPTION OF THE DRAWINGS

The invention will be described with respect to the drawings, of which.

DESCRIPTION OF THE PREFERRED EMBODIMENTS

Figure 1:
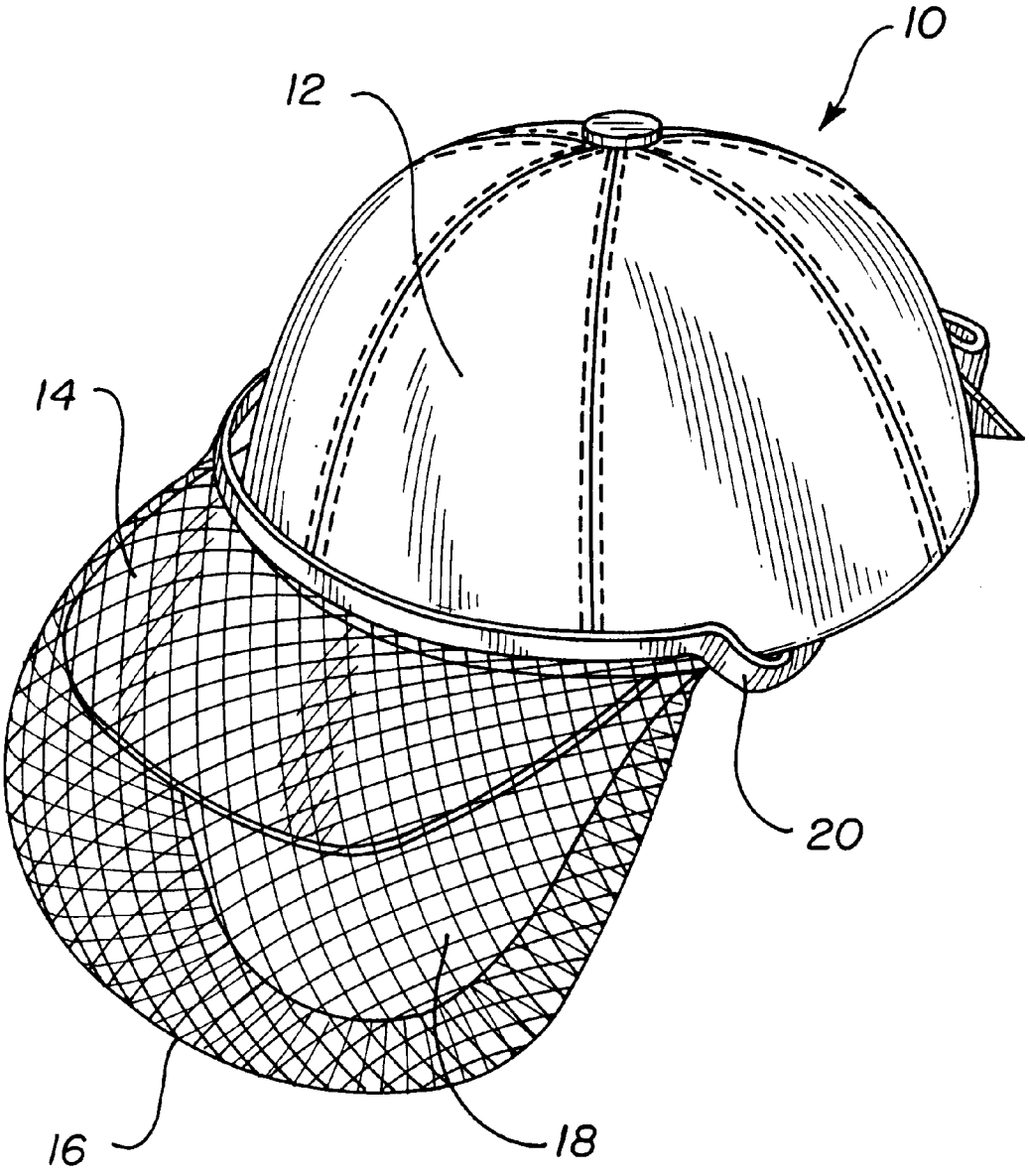
FIG. 1 is a drawing of a sports cap and veil of the invention.

Referring to FIG. 1, a sports cap 10, such as a baseball cap, has a crown 12 and a visor 14. At the front of the cap 10, and setting over the visor 14 is a veil 16 of fine mesh and wide interstices, e.g. 18, to partially cover the face of the wearer. Attached to the sides of the veil 16 are two fabric bands, e.g. 20 which run along the bottom edge of the cap 10, and which may be tied together in the back in a bow by the wearer. In the preferred embodiment, the veil 16 is black in color.

Figure 2:
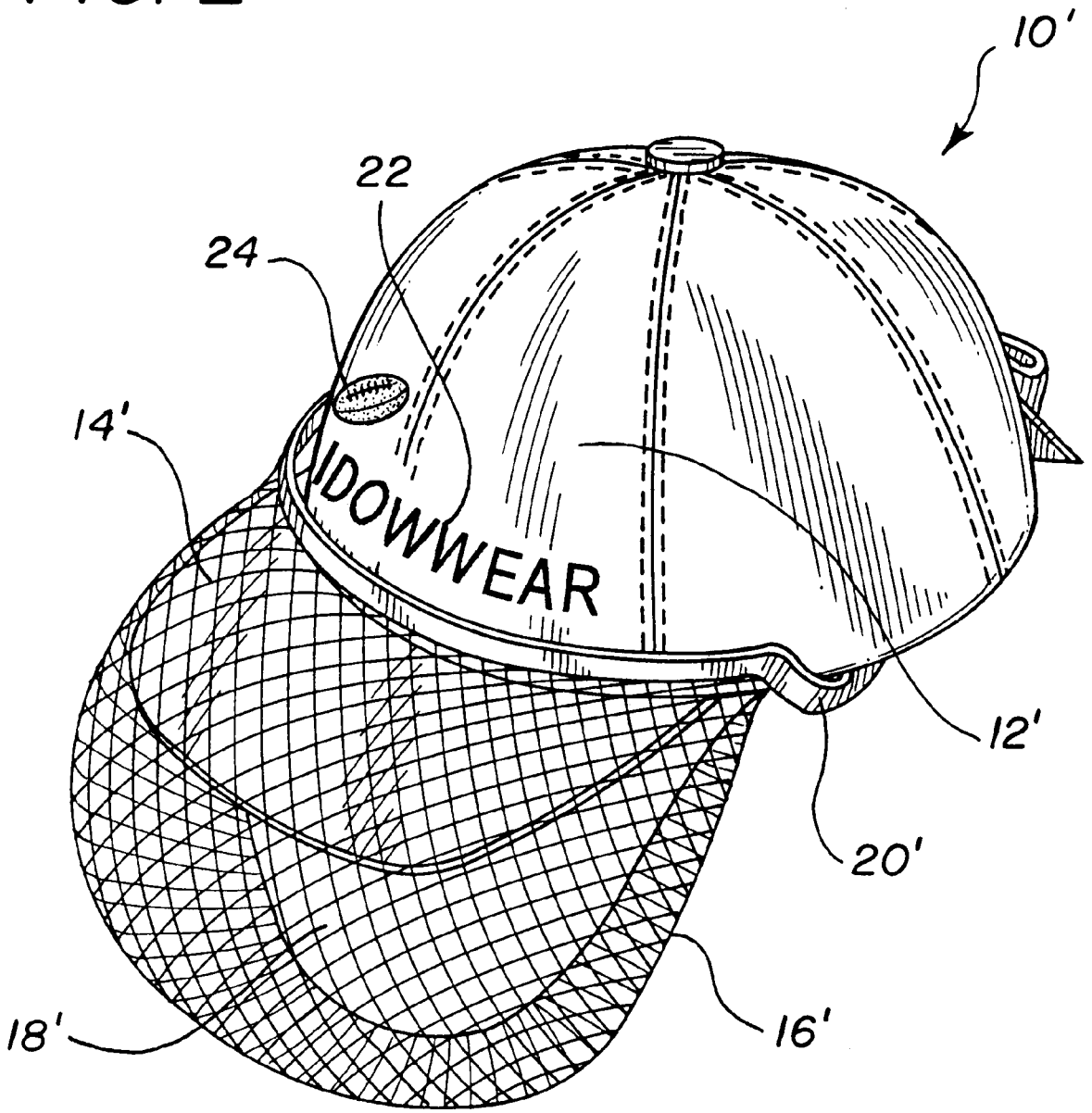
FIG. 2 is a drawing of a sports cap, veil, inscription and icon in accordance with the invention.

In a second embodiment of the invention seen in FIG. 2, the word "WIDOWWEAR", 22 ,is inscribed on the front of the crown 12' of a cap 10'. (In the drawings, different but related elements are identified by the same reference character, albeit that the different elements are distinguished by primes.) This cap 10' has a crown 12', visor 14' , veil 16' with interstices 18' and band 20'. The inscription "WIDOWWEAR" 22 on the crown 12' of the cap 10' added to the veil 16 further emphasizes the "sorrowful" feelings of the female wearing the cap 10'. In addition, an fabric icon 24, e.g. a football, baseball or other sport indicia, indicative of the sport being parodied is attached to the crown 12'.

Figure 3:
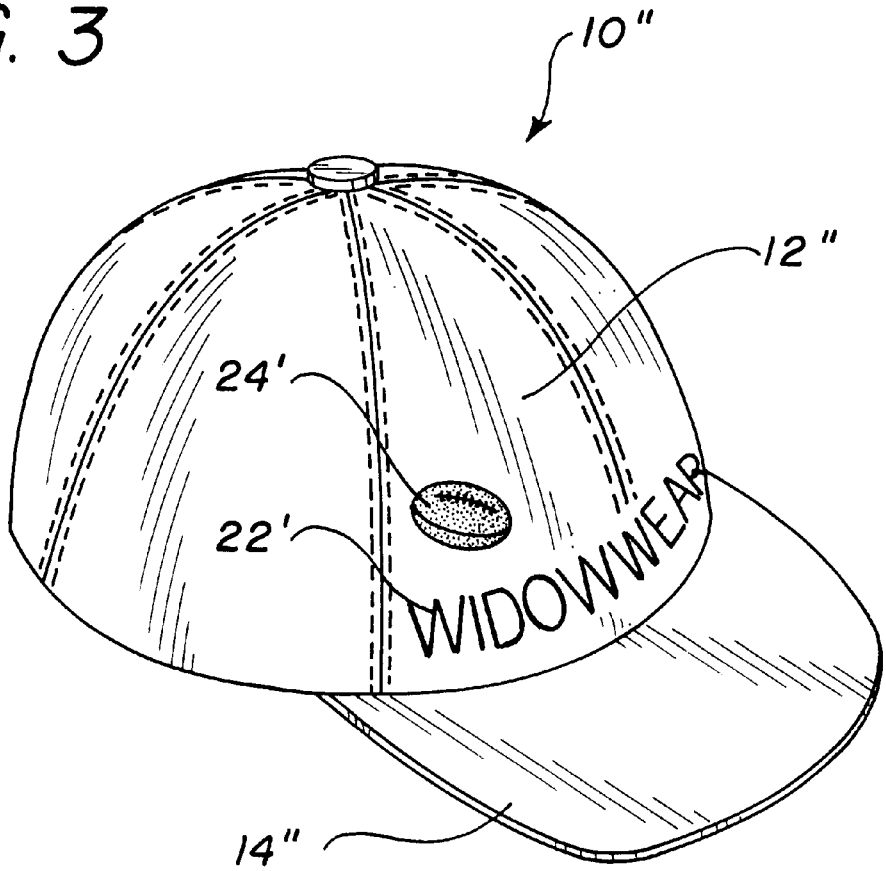
FIG. 3 is a drawing of a third embodiment of the invention.

The third embodiment seen in FIG. 3 discloses a cap 10" having a crown 12" and visor 14". The inscription "WIDOWWEAR" 22' is located on the crown 12", as is an icon 24'.

The invention has been described in detail with particular reference to preferred embodiments thereof, but it will be understood that variations and modifications can be effected within the spirit and scope of the invention. For example, other sports headgear such as fishing hats, golf hats, hunting caps or tennis visors may be used in the implementation of the invention in place of the baseball caps described above.

What is claimed is:

1. An article of manufacture, comprising:

a) a sports headgear, and b) a fabric veil descending from the front of said sports headgear, said fabric veil being a webbed surface of a single uniform color, said fabric veil further having an openwork structure comprising threadlike strands interlinked in wide interstices, whereby the facial expression of the wearer of said headgear and said veil is visible to others through said veil.

2. The article of manufacture of claim 1 wherein said sports headgear is configured as a baseball cap.

3. The article of manufacture of claim 1 wherein said veil is black.

4. An article of manufacture, comprising:

a) a sports headgear, b) a fabric veil descending from the front of said sports headgear, wherein said veil is a webbed surface of a single uniform color, said fabric veil further having an openwork structure comprising threadlike strands interlinked in wide interstices, whereby the facial expression of the wearer of said headgear and said veil is visible to others through said veil, and c) means for verbal indication of widowhood positioned on the front of said headgear.

5. The article of manufacture of claim 4 wherein said sports headgear is configured as a baseball cap.

6. The article of manufacture of claim 4 wherein said means for a verbal indication of widowhood is the word "WIDOWWEAR".

7. The article of manufacture of claim 6 wherein an icon denoting a sport is mounted alongside said word "WINDOWWEAR".

8. The article of manufacture of claim 4 wherein said veil is black.

9. An article of manufacture, comprising:

a) a sports headgear configured as a baseball cap, b) the word "WIDOWWEAR" for verbal indication of widowhood located on the front of said headgear, and c) an icon denoting a sport mounted alongside said word "WIDOWWEAR".

* * * * *